US010555632B1

(12) United States Patent
Sinanovic

(10) Patent No.: US 10,555,632 B1
(45) Date of Patent: Feb. 11, 2020

(54) HOUSE NUMBER ILLUMINATION DEVICE

(71) Applicant: Elvis Sinanovic, Lawrenceville, GA (US)

(72) Inventor: Elvis Sinanovic, Lawrenceville, GA (US)

( * ) Notice: Subject to any disclaimer, the term of this patent is extended or adjusted under 35 U.S.C. 154(b) by 0 days.

(21) Appl. No.: 16/114,861

(22) Filed: Aug. 28, 2018

(51) Int. Cl.
*A47G 29/122* (2006.01)
*G09F 13/22* (2006.01)

(52) U.S. Cl.
CPC ..... *A47G 29/122* (2013.01); *G09F 13/22* (2013.01); *G09F 2013/222* (2013.01)

(58) Field of Classification Search
CPC .. A47G 29/122; A47G 29/12; A47G 29/1212; G09F 13/22; G09F 2013/222; G09F 2013/0418
See application file for complete search history.

(56) References Cited

U.S. PATENT DOCUMENTS 4,901,461 A * 2/1990 Edwards ..... G09F 13/04 340/331
5,813,749 A * 9/1998 Sheldon ..... A47G 29/1209 362/155
D413,704 S 9/1999 Methchear, III
6,033,084 A * 3/2000 Burke ..... A47G 29/1212 362/155
6,708,876 B1 * 3/2004 Shirah ..... A47G 29/1209 232/38
7,299,577 B2 11/2007 Bisson
7,382,252 B2 * 6/2008 Brannon ..... G08B 7/064 232/19
7,549,764 B2 6/2009 Ko
7,578,085 B1 8/2009 Chao
7,966,756 B1 6/2011 Stafford
8,182,113 B2 5/2012 Sharpe
9,826,853 B1 * 11/2017 Fonseca ..... A47G 29/1212
2006/0150453 A1 * 7/2006 Martin ..... G09F 13/22 40/544
2009/0196028 A1 * 8/2009 Chao ..... G09F 13/04 362/183
2015/0062880 A1 * 3/2015 Kleinschmidt ..... G09F 27/005 362/183
2018/0103787 A1 * 4/2018 Fonseca ..... G09F 15/0037

FOREIGN PATENT DOCUMENTS

WO WO97092551 3/1997

* cited by examiner

*Primary Examiner* — Cassandra Davis

(57) ABSTRACT

A house number illumination device for lighting a house number on a mailbox includes a housing that defines an interior space. A power module is coupled to the housing and positioned in the interior space. Each of a plurality of fixtures is operationally coupled to the power module by a respective wire that extends from the housing. Each fixture is configured to couple to a surface proximate to a respective digit of a house number. Each fixture comprises a bulb so that the plurality of fixtures is configured to illuminate the house number.

1 Claim, 5 Drawing Sheets

HOUSE NUMBER ILLUMINATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to illumination devices and more particularly pertains to a new illumination device for lighting a house number on a mailbox.

BRIEF SUMMARY OF THE INVENTION

An embodiment of the disclosure meets the needs presented above by generally comprising a housing that defines an interior space. A power module is coupled to the housing and positioned in the interior space. Each of a plurality of fixtures is operationally coupled to the power module by a respective wire that extends from the housing. Each fixture is configured to couple to a surface proximate to a respective digit of a house number. Each fixture comprises a bulb so that the plurality of fixtures is configured to illuminate the house number.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
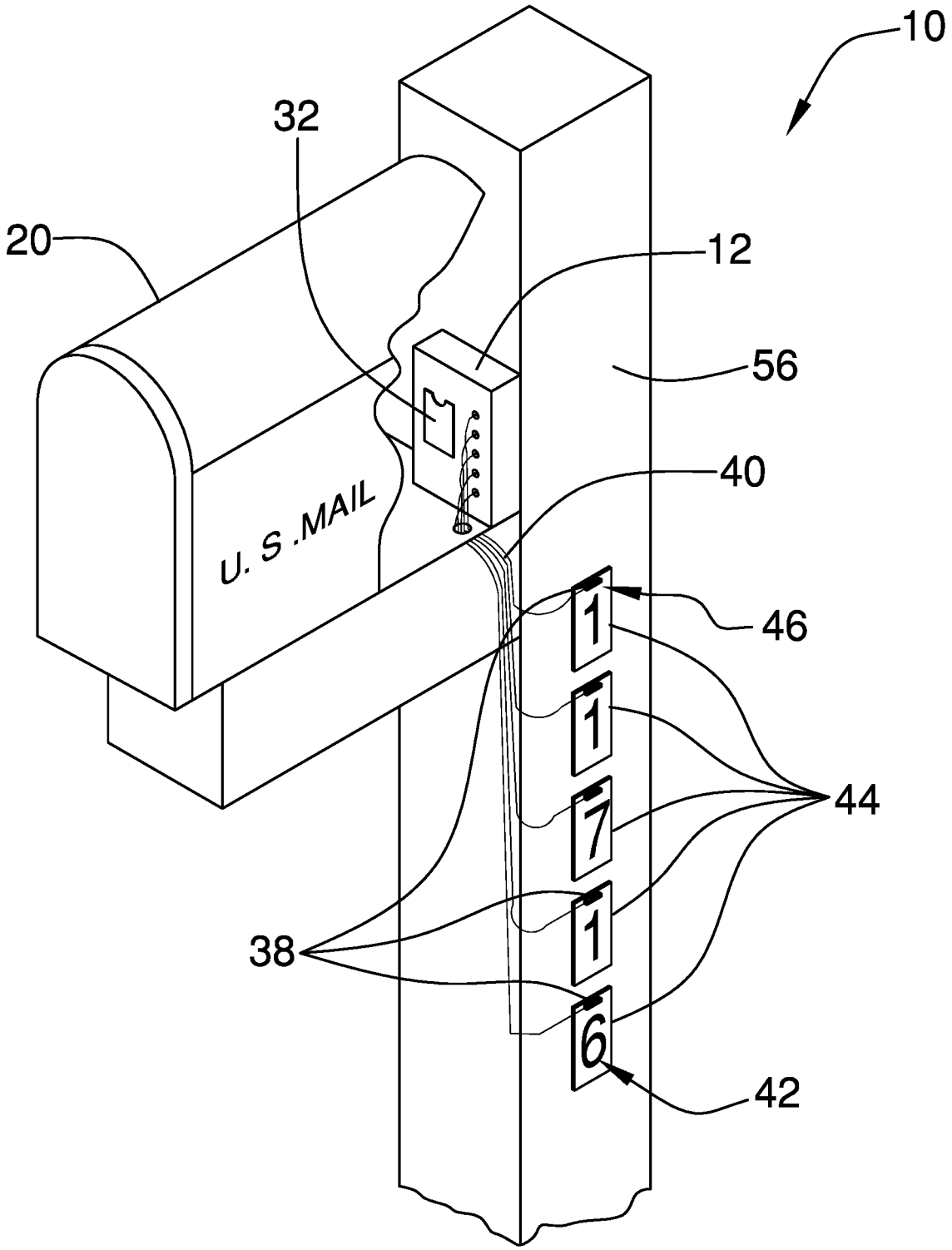
FIG. 1 is an isometric perspective view of a house number illumination device according to an embodiment of the disclosure.

With reference now to the drawings, and in particular to FIGS. 1 through 5 thereof, a new illumination device embodying the principles and concepts of an embodiment of the disclosure and generally designated by the reference numeral 10 will be described.

Figure 2:
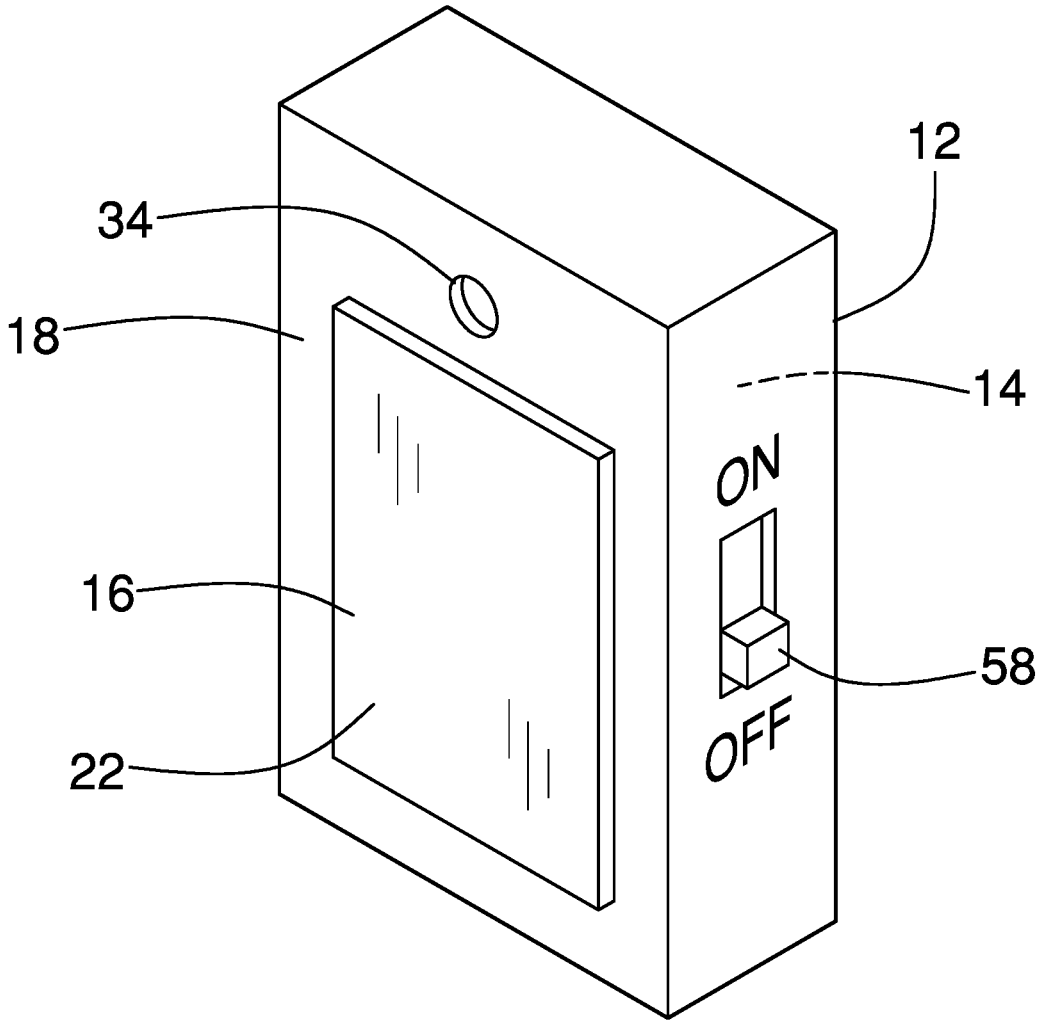
FIG. 2 is an isometric perspective view of an embodiment of the disclosure.

As best illustrated in FIGS. 1 through 5, the house number illumination device 10 generally comprises a housing 12 that defines an interior space 14. The housing 12 is substantially rectangularly box shaped, as shown in FIG. 2. A coupler 16 is coupled to a back 18 of the housing 12 and is configured to couple the housing 12 to a mailbox 20 so that the housing 12 is positioned within the mailbox 20. The coupler 16 comprises a magnet 22 that is configured to couple to a mailbox 20 that comprises a paramagnetic material, such as steel.

A power module 24, which comprises a battery 26, is coupled to the housing 12 and is positioned in the interior space 14. An opening 28 is positioned in a front 30 of the housing 12 proximate to the power module 24. The opening 28 is configured to allow access to the interior space 14 to service the power module 24. A panel 32 is selectively couplable to the housing 12 to close the opening 28.

A hole 34 is positioned through the back 18 of the housing 12. The opening 28 is configured to insert an article of mounting hardware, such as a screw or a bolt, through the hole 34 and a corresponding hole 36 in the mailbox 20 to couple the housing 12 to the mailbox 20 so that the housing 12 is positioned in the mailbox 20. This method of coupling the housing 12 to the mailbox 20 can be used to couple the housing 12 to a mailbox 20 that comprises non-paramagnetic material, such as aluminum or plastic.

Figure 5:
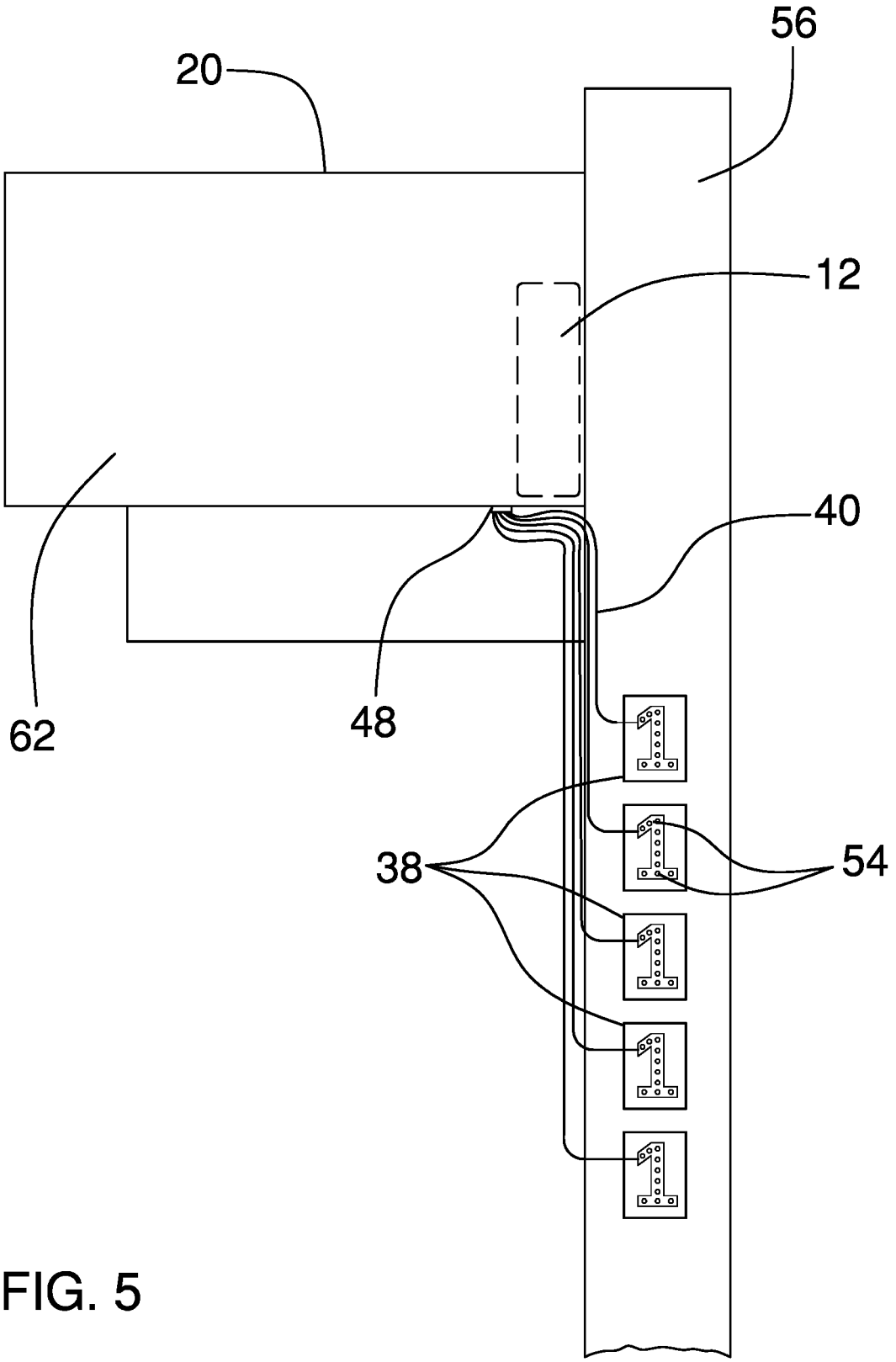
FIG. 5 is an in-use view of an embodiment of the disclosure.

Each of a plurality of fixtures 38 is operationally coupled to the power module 24 by a respective wire 40 that extends from the housing 12, as shown in FIG. 1. Each fixture 38 is configured to couple to a surface proximate to a respective digit 42 of a house number 44. Each fixture 38 comprises a bulb 46 so that the plurality of fixtures 38 is configured to illuminate the house number 44. The plurality of fixtures 38 comprises five fixtures 38. Each wire 40 extends from the power module 24 through a drain hole 48 that is positioned in a bottom 50 of the mailbox 20. Alternatively, as shown in FIG. 5, each wire 40 extends from the power module 24 through a slot 60 that is positioned in a side 62 of the mailbox 20. For use with house number 44 that has less than five digits 42, an appropriate number of fixtures 38 would be retained in the mailbox 20.

Figure 3:
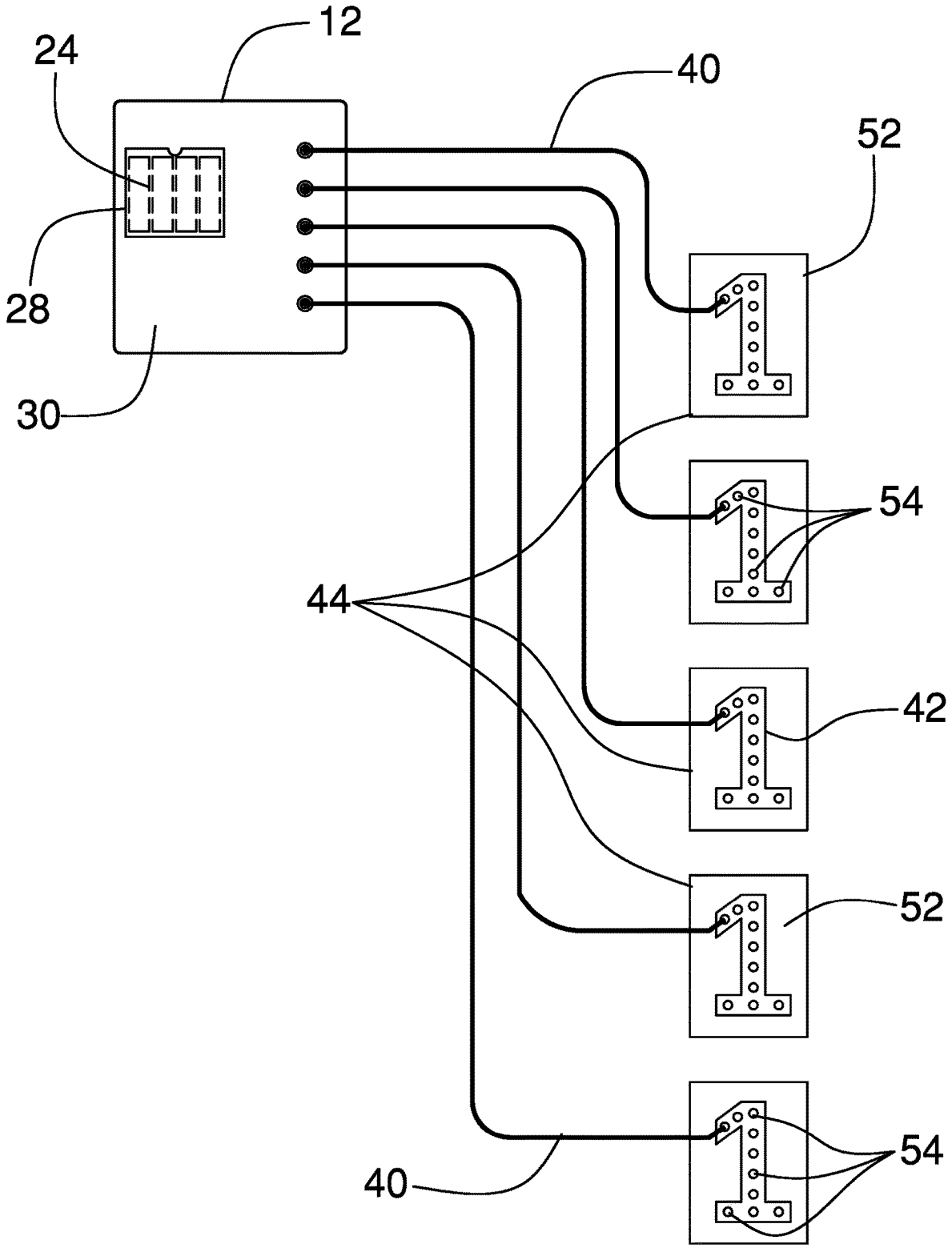
FIG. 3 is a front view of an embodiment of the disclosure.
Figure 4:
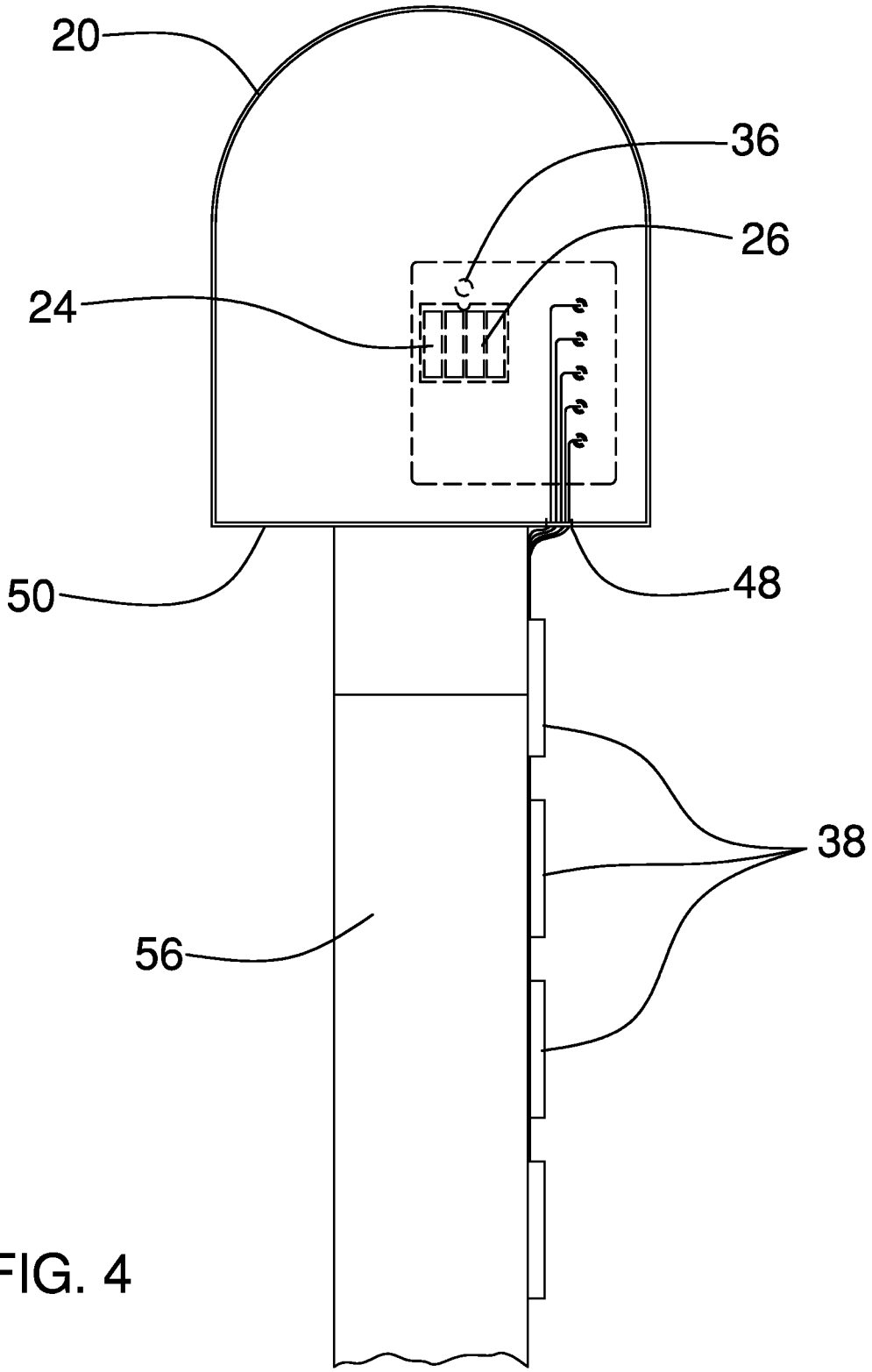
FIG. 4 is an in-use view of an embodiment of the disclosure.

In one embodiment, as shown in FIG. 3, each fixture 38 comprises a plate 52 that is rectangularly shaped. The bulb 46 is coupled to the plate 52. The bulb 46 comprises a set of light emitting diodes 54 that is arrayed on the plate 52 so that the set of light emitting diodes 54 forms the respective digit 42 of the house number 44. In this embodiment, each plate 52 would be coupled to a post 56 supporting the mailbox 20, using techniques well known to those skilled in the art, so that the plates 52 are sequenced in the same order as the house number 44.

A switch 58 is coupled to the housing 12, as shown in FIG. 2. The switch 58 is operationally coupled to the power module 24 and the plurality of fixtures 38. The switch 58 is positioned to selectively and operationally couple the power module 24 to the plurality of fixtures 38 to illuminate the house number 44. The switch 58 enables a user to selectively illuminate the house number 44.

In use, the housing 12 is coupled to the mailbox 20 using either the magnet 22 or the hole 34 and the article of mounting hardware. Each wire 40 is extended from the housing 12 through the drain hole 48 in the mailbox 20, positioning an associate fixture 38 to be coupled to the post 56. The switch 58 is used to couple the power module 24 to the plurality of fixtures 38 to illuminate the house number 44.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A house number illumination device comprising:

a housing defining an interior space, the housing being substantially rectangularly box shaped;

a coupler coupled to a back of the housing wherein the coupler is configured for coupling the housing to a mailbox such that the housing is positioned within the mailbox, the coupler comprising a magnet wherein the magnet is configured for coupling to a mailbox comprising a paramagnetic material for coupling the housing to the mailbox;

a power module coupled to the housing and positioned in the interior space, the power module comprising a battery;

an opening positioned in a front of the housing proximate to the power module wherein the opening is configured for accessing the interior space for servicing the power module;

a hole positioned through the back of the housing wherein the opening is configured for inserting an article of mounting hardware through the hole and a corresponding hole in the mailbox for coupling the housing to the mailbox such that the housing is positioned in the mailbox;

a panel selectively couplable to the housing for closing the opening;

a plurality of fixtures, each fixture being operationally coupled to the power module by a respective wire extending from the housing, each fixture being configured for coupling to a surface proximate to a respective digit of a house number, each fixture comprising a bulb wherein the plurality of fixtures is configured for illuminating the house number, the plurality of fixtures comprising five fixtures, each wire extending from the power module wherein each wire is configured to extend through a drain hole positioned in a bottom of the mailbox, each fixture comprising:

a plate, the plate being rectangularly shaped, and the bulb being coupled to the plate, the bulb comprising a set of light emitting diodes, the set of light emitting diodes being arrayed on the plate such that the set of light emitting diodes forms the respective digit of the house number; and a switch coupled to the housing, the switch being operationally coupled to the power module and the plurality of fixtures wherein the switch is positioned for selectively operationally coupling the power module to the plurality of fixtures for illuminating the house number.

* * * * *